US005800240A

United States Patent [19]

Jackson

[11] Patent Number: 5,800,240

[45] Date of Patent: Sep. 1, 1998

[54] MARBLE RACE TOY WITH ELEVATOR AND SUPPORTING INFRASTRUCTURE

[76] Inventor: Douglas L. Jackson, 745 Casterwood Ct., San Jose, Calif. 95120

[21] Appl. No.: 657,856

[22] Filed: May 31, 1996

[51] Int. Cl.[6] ..... A63H 18/02; A63H 15/00; A63H 29/08; A63H 33/06

[52] U.S. Cl. ..... 446/171; 446/120; 446/168

[58] Field of Search ..... 446/168, 171–174, 446/120

[56] References Cited

U.S. PATENT DOCUMENTS

| | | | |
|---|---|---|---|
| 2,000,808 | 5/1935 | Williams | 446/168 |
| 3,108,810 | 10/1963 | Wiley, Jr. | 446/171 X |
| 3,221,439 | 12/1965 | Schaper | 446/120 |
| 3,251,155 | 5/1966 | Bjork | 446/172 |
| 3,360,883 | 1/1968 | Glanzer | 446/120 |
| 3,496,669 | 2/1970 | Siggelkow | 446/168 X |

*Primary Examiner*—Robert A. Hafer
*Assistant Examiner*—Laura Fossum
*Attorney, Agent, or Firm*—The Kline Law Firm

[57] ABSTRACT

A marble race toy including a modular track that is assembled by the user from channel components into any desired configuration. An infrastructure is utilized to support the desired track layout. An infrastructure is utilized to support the desired track layout. Affixing elements are used to fix dowel rods of the infrastructure in place, and thereby support the modular components of the track. An elevator with an endless conveyor raises the marbles to a start position of the track, and retrieves them from an end position of the track.

9 Claims, 5 Drawing Sheets

MARBLE RACE TOY WITH ELEVATOR AND SUPPORTING INFRASTRUCTURE

FIELD OF THE INVENTION

The present invention relates generally to toys and games, and more particularly is a marble race toy with an elevator and unique supporting means for the multiple segments of the track.

BACKGROUND OF THE INVENTION

Marble race toys, toys in which a marble or ball traverses a winding path, have been in existence for some time. The toys operate by having a starting position for the ball or marble that is elevated. When the marble is released, it rolls along a track constructed to provide a winding path. Some raceways are constructed in modular fashion so that the user can change the path to maintain interest in the game.

Early examples of such toys are the "Toy" of A. S. McCoy, U.S. Pat. No. 1,195,927, issued Aug. 22, 1916; and the "Toy" of F. V. Williams, U.S. Pat. No. 2,000,808, issued May 7, 1935. Further examples are the "Rolling Ball and Track Toy" of Ray L. Stair, U.S. Pat. No. 2,532,521, issued Dec. 5, 1959; "Marble Runway" of Frances Elizabeth Cook, U.S. Pat. No. 2,729,914, issued Jan. 10, 1956; "Knockdown Marble Railway Toy" of E. M. Grosser, U.S. Pat. No. 3,145,501, issued Aug. 25, 1964; and most recently, "Jump Chute Marble Race Toy" of Daniel B. Klitsner, U.S. Pat. No. 4,874,342, issued Oct. 17, 1989.

These devices provide a track with an elevated starting point for a marble to roll on a circuitous track that leads to an end point. Also disclosed in the prior art are various means of elevating the marble and of securing the elements of the track in position.

The idea of watching an object roll along a track is quite amusing and through the prior art one can see that many varieties of track design have been utilized. However, the prior art discloses devices that are somewhat limited in adaptability to the user, therefore limiting their usefulness. Most of the prior art designs are fairly rigid, with little thought given to ease of assembly and use, or to the feasibility of mass production.

OBJECTS, SUMMARY, AND ADVANTAGES OF THE INVENTION

Accordingly, it is an object of the present invention to provide a toy that is entertaining for children and adults to watch and to assemble and to disassemble.

It is another object of the present invention to provide a toy that automatically raises marbles to a starting point of a gravity operated raceway.

It is a further object of the present invention to create a toy that has a supporting infrastructure for the track.

In summary, the present invention is a marble race toy. The toy comprises a modular track that is assembled from channel components by the user into any desired configuration. An infrastructure is utilized to support the desired track layout. Affixing elements are used to fix dowel rods of the infrastructure in place, and thereby support the modular components of the track. An elevator with an endless conveyor raises the marbles to a start position, and retrieves them from an end position.

An advantage of the present invention is that it may be operated continuously with no physical intervention on the part of the user.

Another advantage of the present invention is that the track can be configured in any way desired by the user.

A still further advantage of the present invention is that the supporting infrastructure stabilizes the modular components of the raceway.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIG. 2*c* shows a perpendicular affixing member.

BEST MODE OF CARRYING OUT THE INVENTION

Figure 5:
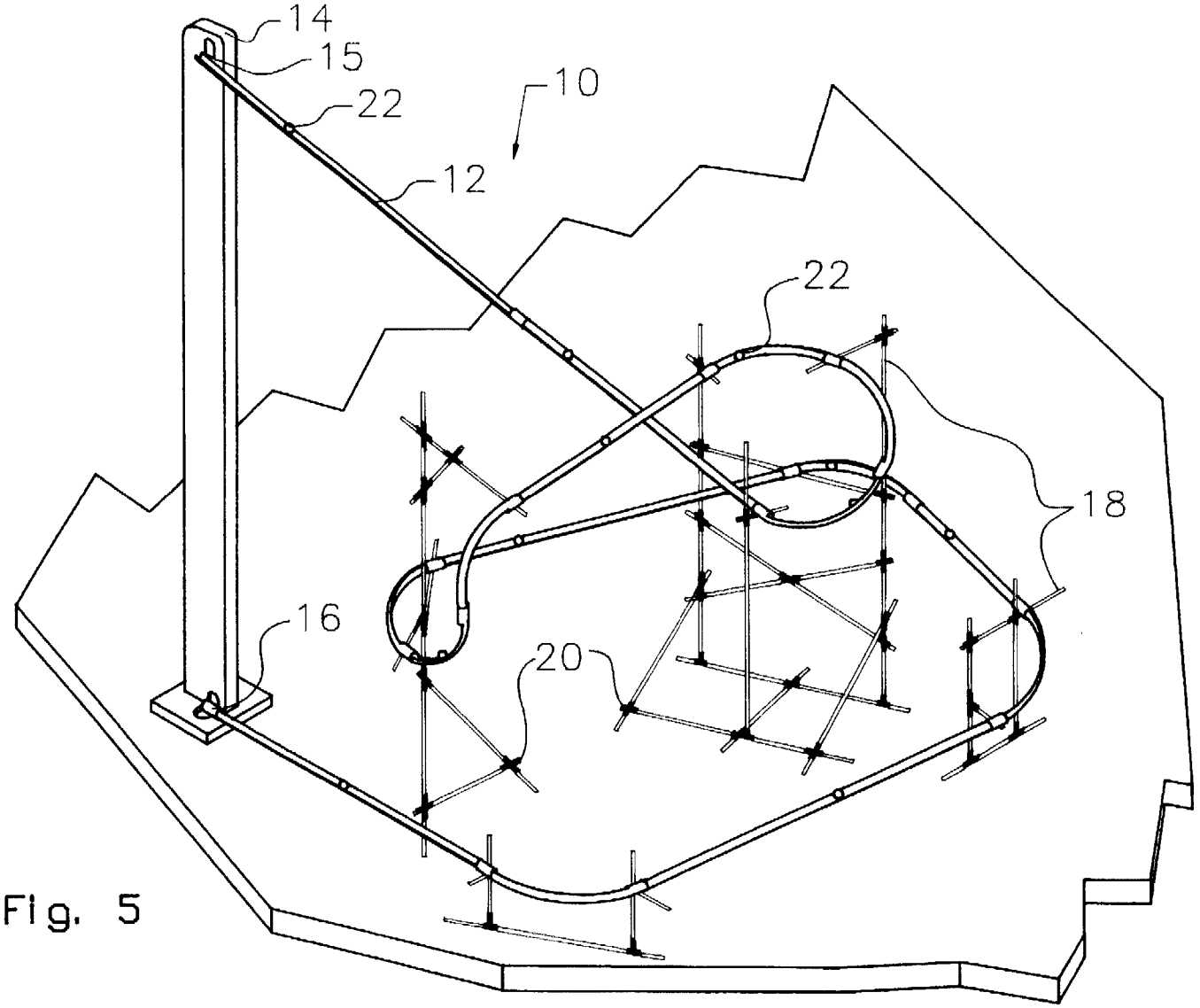
FIG. 5 is a perspective view of an embodiment of the marble race game of the present invention.

The present invention is a marble race game or toy 10. As illustrated in FIG. 5, the track 12 for the toy can be laid out in as complex (or simple) a manner as is desired by a user. An elevator 14 with an endless conveyor is in communication with a starting point 15 and an end point 16 for the track. An infrastructure comprises a plurality of dowel rods 18 and affixing means 20. The affixing means 20 allow the dowel rods to be secured in various configurations so as to support the layout of the track 12 as constructed by the user. Marbles 22 travel along the path defined by the track 12. It should be noted that "marble" as defined herein is not limited to a marble per se. The definition of "marble" herein encompasses any spheroidal object of sufficient mass.

Figures 1A, 1B, 1C:
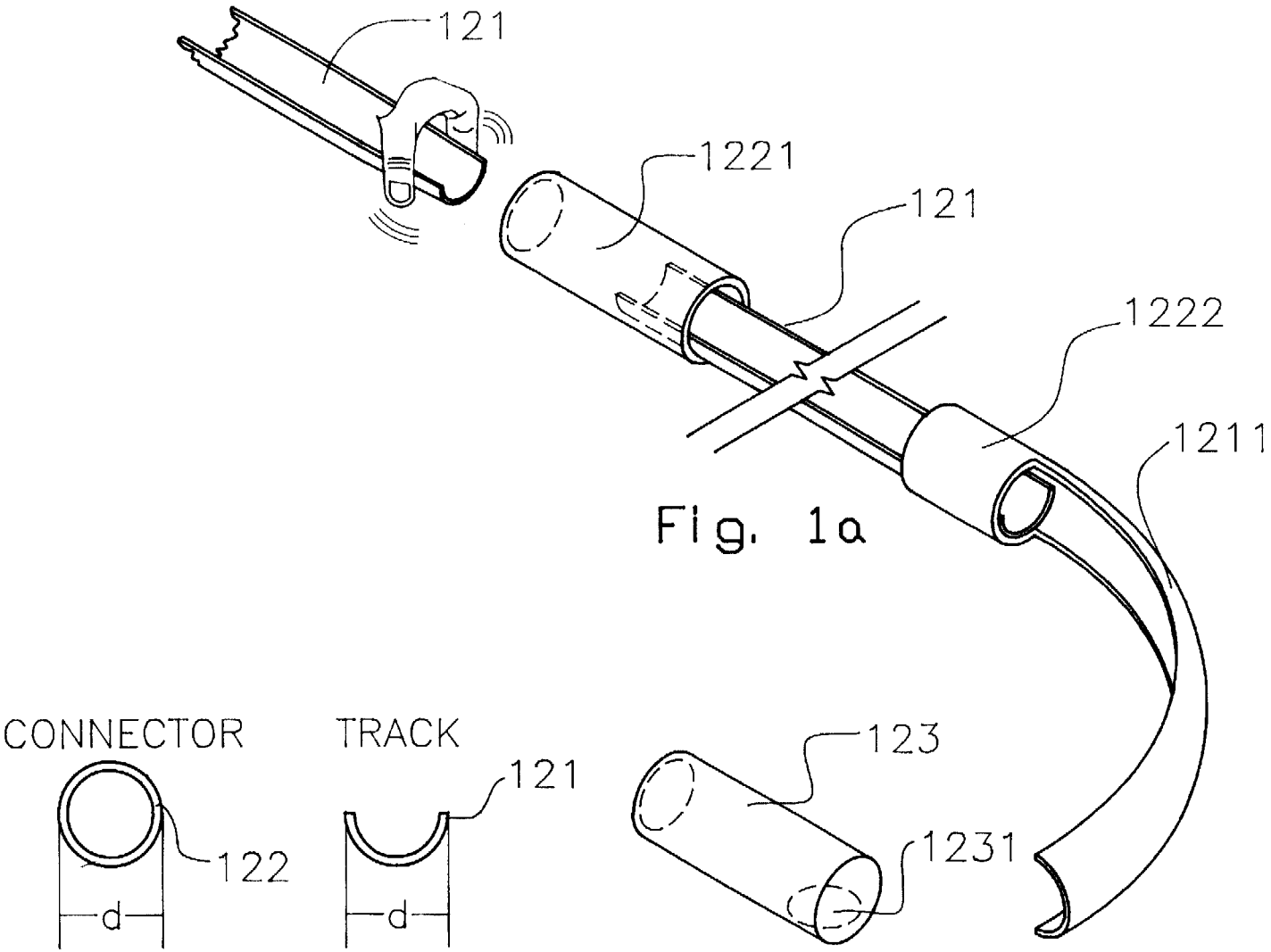
FIG. 1*a* is a broken view of a section of the raceway showing the joint forming means, said joints joining both straight and curved track sections.
FIG. 1*b* shows the cross section of a connector and the track.
FIG. 1*c* shows the terminal end of the track.

FIGS. 1*a*–1*c* illustrate the components of the track 12. The main element of the track 12 is the channel 121, a u-shaped or semicircular element as shown in FIGS. 1*a* and 1*b*. A curved element 1211 is also a u-shaped channel that is bent or molded to a curved shape. The curve can be any arc chosen by the user, but will generally be an arched quarter turn. In the preferred embodiment, the channel 121 is formed from PVC. The channel 121 and the curved elements 1211 can of course be cut to any length desired by the user.

A connector 122 is used to join units of the channel 121. The connector 122 is a fully cylindrical member with the same diameters, both inner and outer, as the channel 121. (See FIG. 1*b*.) The connector 122 may be either an independent unit, as is connector 1221, or it can be formed integral to the channel, as is connector 1222.

To join multiple units of the channel 121, the user squeezes an end of the channel 121 so that it is slightly compressed, (see FIG. 1*a*), thereby enabling the user to insert the end of the channel into the connector 122. When the user releases the end of the channel, it is secured by a friction fit in the connector 122. The joint thus formed presents little or no resistance to the forward motion of the marble 22.

The user joins a plurality of channel units 121 until the track 12 is in the configuration desired. The user may connect as many channel units 121, both straight and curved 1211, as he desires, creating whatever configuration of track he chooses. See FIG. 5. The only limitation to the configuration is that a sufficient overall downward slope of the track 12 must be preserved to maintain the necessary velocity of the marbles 22 to maneuver the curves of the track 12.

The unique design of the channel 121 and the curved elements 1211 enable the marble 22 to travel the course of the track 12 at relatively high speeds without flying off the track. The curved elements 1211 can be mounted in any orientation desired, and will still contain the marble 22 provided the marble 22 has sufficient forward momentum as it enters the curved element 1211. The curved elements 1211 may be joined together to form any conformation of curve desired by the user.

Figure 4:
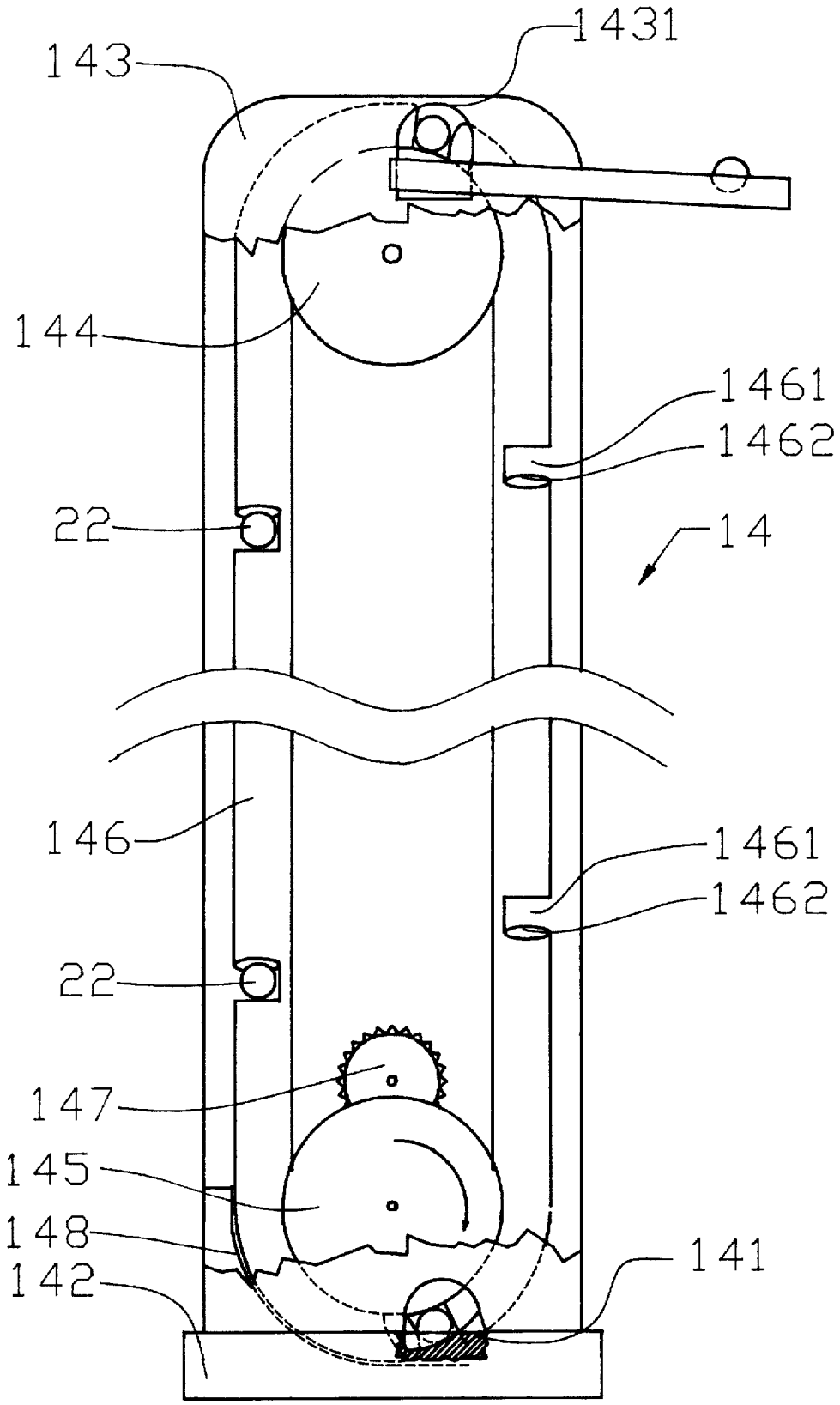
FIG. 4 is a front view of the elevator.

An end cap 123 is utilized at the terminal end of the track 16. The end cap 123 includes an aperture 1231 that allows the marbles 22 to drop into a staging area 141 of the elevator 14. (See FIGS. 4 and 5.)

The elevator 14 further includes a base 142, a cover 143, and a guide way 148. An upper pulley 144 and a lower pulley 145 drive a conveyor belt 146. An electric motor provides power to the lower pulley 145 through a gearing mechanism 147. A plurality of spaced receiving notches 1461 are provided in the conveyor belt 146 to receive the marbles 22. The conveyor belt 146 is constructed from a flexible material. This allows the receiving notch 1461 to expand as it is driven around the pulleys 144, 145.

As each of the receiving notches 1461 pass around the lower pulley 145, the receiving notch expands so as to receive a marble 22. The marbles 22 are urged into the path of the conveyor belt 146 by the conformation of the staging area 141, which includes a downward sloping angle. As the notch 1461 of the belt 146 moves through the staging area 141, the marble 22 rolls into the path of the conveyor belt 146. As the notch 1461 passes the staging area, the marble 22 is pushed along in the notch. Guide way 148 steers the marble 22 until the notch 1461 passes the pulley 145. The notch 1461 then contracts to secure the marble 22.

The belt 146 carries the marble 22 to the top pulley 144. As the notch 1461 passes around the top pulley 144, it is again expanded, thereby releasing the marble 22. Notch 1461 includes a slanted forward wall 1462 that urges the marble out of the path of the conveyor belt 146. The marble 22 then passes through an opening 1431 in the cover 143 onto the starting point 15 of the track 12. The marble then continues its journey along the course of the track to the end point 16.

The track 12 is laid out by the user's placing of the assembled channels 12 onto a supporting infrastructure comprising dowel rods 18 and affixing means 20. The affixing means are illustrated in FIGS. 2*a–e*. The affixing means 20 are combined with the dowel rods 18 to form the infrastructure that supports the track 12 as shown in FIG. 3.

Figure 2A:
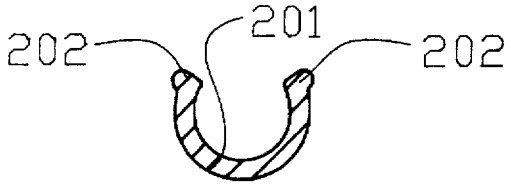
FIG. 2*a* is a cross section of a receiving trough of an affixing member.
Figure 2B:
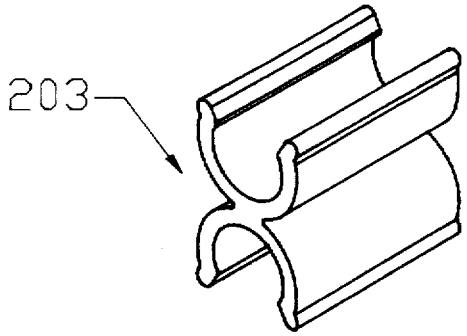
FIG. 2*b* shows a parallel affixing member.
Figure 2C:
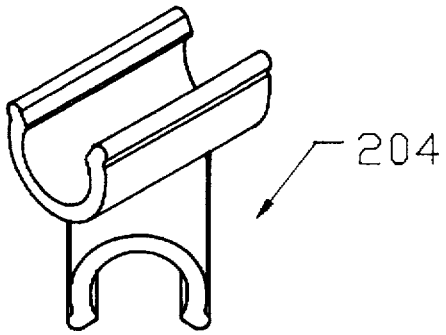
FIG. 2*c* shows a 45° affixing member.
Figure 2D:
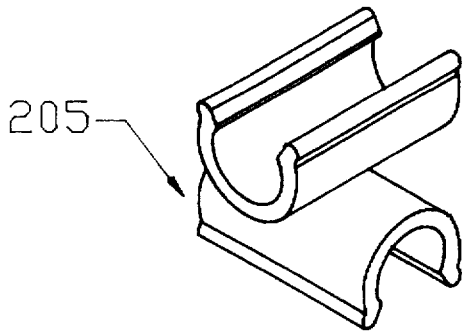
FIG. 2*d* shows a 90° affixing member.
Figure 2E:
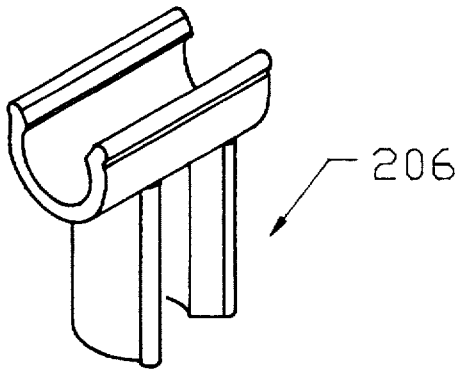

FIG. 2*a* shows a cross section of a receiving trough 201 of the affixing means 20. The arc of the receiving trough 201 is greater than 180° so that when a dowel rod 18 is pressed into the receiving trough 201 of the affixing means 20, the opening of the receiving rough 201 is spread apart by means of pressure applied to flanges 202. As the dowel rod 18 is seated into trough 201, trough 201 returns to nearly its original shape. In this manner the affixing means 20 firmly secures dowel rod 18 by friction of the flexed walls of the receiving trough 201.

The affixing means 20 are constructed to provide an intersection point for at least two dowel rods 18. The affixing means 20 are constructed with at least two receiving troughs secured back-to-back at varying angles. Affixing means 203 has the two troughs in parallel for end-to-end joining of the dowel rods. Means 204 includes two troughs secured at a 45° angle to create a 45° dowel intersection, while means 205 includes two troughs secured at a 90° angle to create a 90° dowel intersection. Affixing means 206 is constructed so that an open end of a first receiving trough is affixed to the rear of a second receiving trough so that dowel rods 18 inserted therein will form a T intersection.

Figure 3:
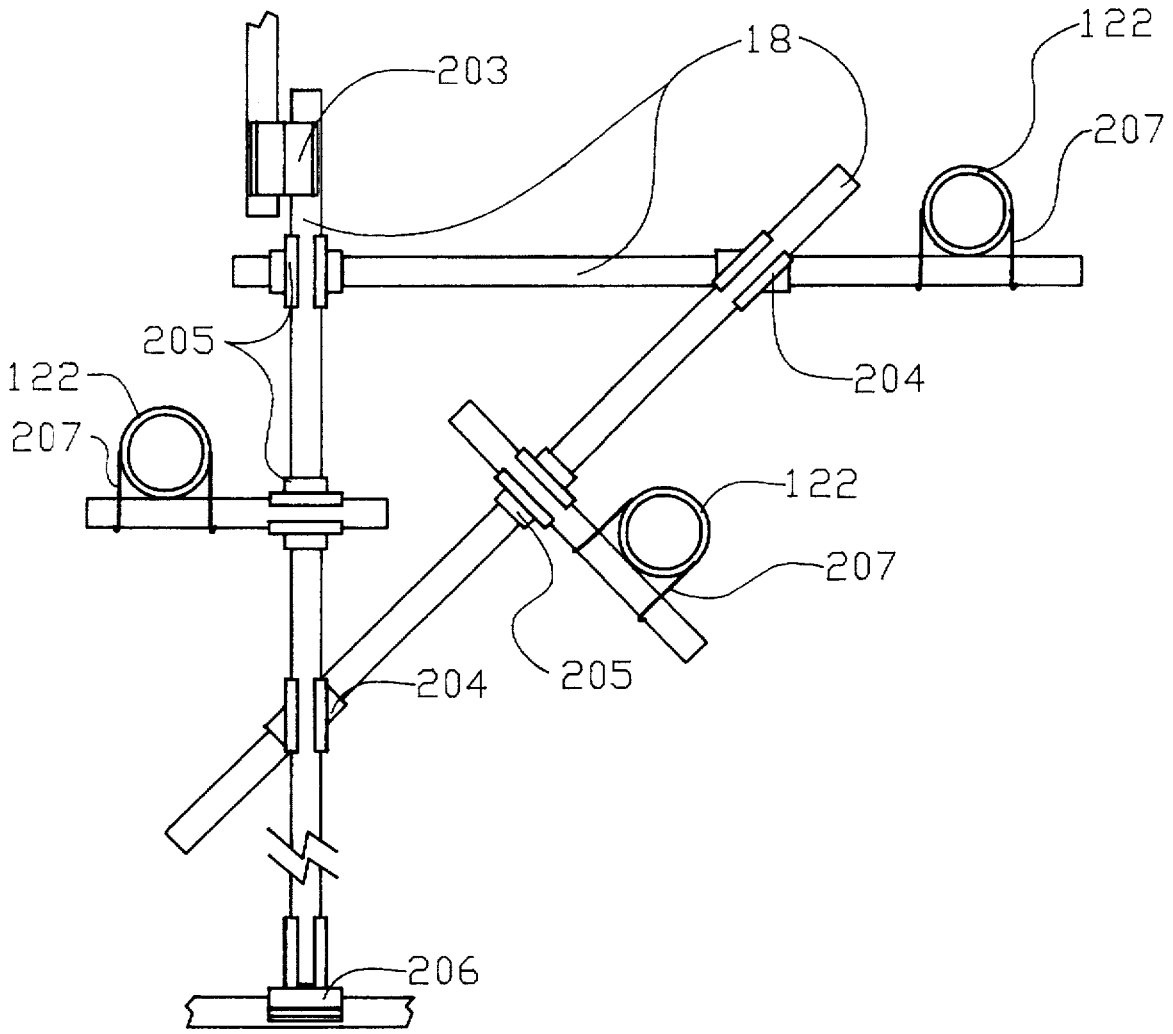
FIG. 3 illustrates several dowel rods of the infrastructure joined by affixing members, with segments of the track connectors shown in cross section.

As illustrated in FIG. 3, the infrastructure is built by joining a plurality of dowel rods 18 with the affixing means 20. Using the various conformations of the affixing means 203–206, the rods 18 are joined at various angles to conform to the structure of track that the user wants to build. After the infrastructure has been built, the user joins multiple units of channel 121 to create the track 12.

An elastic strap 207 (FIG. 3) is wrapped around the connector 122 and the protruding dowel rod 18 to secure the track 12 in position. Track height adjustments can be made by sliding the affixing means 20 up or down the dowel rod 18.

After construction of the track 12, the user is ready to operate the device. The electric motor that powers the elevator 14 is turned on, and the conveyor 146 begins to rotate. Marbles placed in the staging area 141 are lifted to the top of the elevator, where they pass around upper pulley 144. As the marbles pass the top of upper pulley 144, they fall into the starting point 15 of the track 12. The marbles then proceed along the track 12 until they arrive at the end point 16, where they fall through the aperture 1231 in the end cap 123, and are again deposited in the staging area 141.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A marble race toy comprising:

a track comprising a plurality of straight and curved modular channel components, said components being joined by at least one connector, an elevator including an endless conveyor, said endless conveyor being formed from a flexible member, said flexible member being a solid cylindrical member substantially circular in cross section, said flexible member includes a plurality of notches therein, said elevator being in communication with a starting point and an end point of said track such that as each said notch passes over a lower pulley, said notch is expanded to receive a marble, said marble being in contact with a top and a bottom side of said notch as said notch contracts after it has passed over said pulley, and when said notch passes over an upper pulley, said notch is again expanded, thereby releasing said marble, an infrastructure comprising a plurality of dowel rods and affixing means, said affixing means releasably secure said dowel rods in various configurations so as to support a layout of said track as desired by a user, and marbles that travel along a path defined by said track; wherein said marbles are raised by said endless conveyor of said elevator from a staging area of said elevator to said starting point of said track where said marbles are released, said marbles thereafter being urged by gravity along said track to said end point of said track, said end point of said track being in communication with said staging area of said elevator.

2. The marble race toy of claim 1 wherein:

said connector is a cylindrical member with an inner diameter equal to an inner diameter of said channel components and an outer diameter equal to an outer diameter of said channel components, said channel components being adapted to be compressed for insertion into said connector.

3. The marble race toy of claim 1 wherein:

said connector is integral with at least one of said channel components.

4. The marble race toy of claim 1 wherein:

said connector is an independent element.

5. The marble race toy of claim 2 wherein:

said connector is integral with at least one of said channel components.

6. The marble race toy of claim 2 wherein:

said connector is an independent element.

7. The marble race toy of claim 1 wherein:

said elevator includes a guide way that directs said marbles from said staging area into said notches in said endless conveyor.

8. The marble race toy of claim 7 wherein:

said notches include a slanted wall to direct said marbles onto said starting point of said track.

9. The marble race toy of claim 1 wherein:

said affixing means include a first receiving trough with a bottom side affixed directly to a bottom side of a second receiving trough, each said receiving trough has an arc greater than 180°, each said receiving trough includes a flange extending outward along each side of an opening of said receiving trough such that said flange does not lie on an arc of said opening, and each said opening has a length greater than a diameter of said opening; such that said opening of said receiving trough is spread apart by means of pressure applied to said flanges so as to receive said dowel rods, and said affixing means can be applied at any point along the length of said dowel rods.

* * * * *